US010343172B2

(12) United States Patent
Lindberg et al.

(10) Patent No.: US 10,343,172 B2
(45) Date of Patent: Jul. 9, 2019

(54) GYRATORY CRUSHER OUTER CRUSHING SHELL

(71) Applicant: SANDVIK INTELLECTUAL PROPERTY AB, Sandviken (SE)

(72) Inventors: Mikael Lindberg, Svedala (SE); Jonny Hansson, Malmo (SE); Torbjorn Nilsson-Wulff, Svedala (SE); Andreas Christoffersson, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/928,864

(22) Filed: Mar. 22, 2018

(65) Prior Publication Data

US 2018/0221886 A1 Aug. 9, 2018

Related U.S. Application Data

(63) Continuation of application No. 14/200,757, filed on Mar. 7, 2014, now abandoned.

(30) Foreign Application Priority Data

Mar. 8, 2013 (WO) ..... PCT/EP2013/054680

(51) Int. Cl.

| | |
|---|---|
| ***B02C 2/04*** | (2006.01) |
| ***B02C 2/02*** | (2006.01) |
| ***B02C 2/00*** | (2006.01) |
| ***B02C 2/06*** | (2006.01) |

(52) U.S. Cl.

CPC ..... *B02C 2/04* (2013.01); *B02C 2/005* (2013.01); *B02C 2/02* (2013.01); *B02C 2/06* (2013.01)

(58) Field of Classification Search

CPC .. B02C 2/04; B02C 2/02; B02C 2/005; B02C 2002/002

USPC ..... 241/207–216

See application file for complete search history.

(56) References Cited

U.S. PATENT DOCUMENTS

| | | | | |
|---|---|---|---|---|
| 3,887,143 A * | 6/1975 | Gilbert | B02C 2/04 | 241/215 |
| 4,206,881 A * | 6/1980 | Werginz | B02C 2/047 | 241/207 |
| 4,339,087 A * | 7/1982 | Pollak | B02C 2/06 | 241/207 |
| 4,892,257 A * | 1/1990 | Stoeckmann | B02C 2/047 | 241/208 |
| 5,649,669 A * | 7/1997 | Ambrose | B02C 2/045 | 241/207 |
| 5,732,896 A * | 3/1998 | Jakob | B02C 2/047 | 241/215 |

(Continued)

*Primary Examiner* — Anthony D Stashick
*Assistant Examiner* — Onekki P Jolly
(74) *Attorney, Agent, or Firm* — Corinne R. Gorski

(57) ABSTRACT

A gyratory crusher includes an inner and an outer crushing shell. The outer crushing shell has three regions along its axial length including: an inlet region that tapers radially inward from an uppermost first end; a crushing region that extends radially inward from a second lowermost end; and a radially innermost shoulder region that is positioned axially between the inlet and crushing regions. An angle of inclination of a radially inward facing surface at the inlet and shoulder regions and the axial length of the crushing surface are designed to optimize crushing capacity in addition maximizing reduction.

14 Claims, 3 Drawing Sheets

(56) References Cited

U.S. PATENT DOCUMENTS

| | | | | |
|---|---|---|---|---|
| 5,934,583 | A * | 8/1999 | Jean | B02C 2/06 241/209 |
| 2004/0159728 | A1 * | 8/2004 | Hamada | B02C 2/005 241/209 |
| 2005/0133647 | A1 * | 6/2005 | Evertsson | B02C 2/005 241/207 |
| 2005/0156070 | A1 * | 7/2005 | Olsson | B02C 2/005 241/207 |

* cited by examiner

GYRATORY CRUSHER OUTER CRUSHING SHELL

RELATED APPLICATION DATA

The present application is a continuation of patent application Ser. No. 14/209,757, filed Mar. 7, 2014, which claims priority under 35 U.S.C. § 119 to Patent Application No. PCT/EP2013/054680, filed on Mar. 8, 2013, which the entirety thereof is incorporated herein by reference.

TECHNICAL FIELD

The present disclosure relates to a gyratory crusher outer crushing shell and in particular, although not exclusively, to a crushing shell having a radially inward projecting shoulder positioned axially intermediate between an upper inlet region and a lower crushing region, the inlet, shoulder and crushing region being optimised to increase the capacity and reduction effect of the crusher.

BACKGROUND

Gyratory crushers are used for crushing ore, mineral and rock material to smaller sizes. The crusher includes a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2004/110626; WO 2008/140375, WO 2010/123431, US 2009/0008489, GB 1570015, U.S. Pat. No. 6,536,693, JP 2004-136252, U.S. Pat. No. 1,791,584 and WO 2012/005651.

Gyratory crushers (encompassing cone crushers) are typically designed to maximise crushing efficiency that represents a compromise between crushing capacity (the throughput of material to be crushed) and crushing reduction (the breakdown of material to smaller sizes). This is particularly true for heavy-duty primary crushers designed for mining applications. The capacity and reduction may be adjusted by a variety of factors including in particular size of the crushing chamber, the eccentric mounting of the main shaft and the shape, configuration and setting of the opposed crushing shells.

For example, the design of the outer crushing shell has a significant effect on the capacity and reduction of the crusher. In particular, an outer crushing shell with an inner facing contact surface that tapers inwardly towards the mantle acts to accelerate the through-flow of material. However, conventional designs of this type fall short of optimising capacity whilst increasing reduction and there is therefore a need for an improved outer crushing shell with improved performance.

SUMMARY OF THE INVENTION

It is an objective of the present disclosure to provide an outer crushing shell that is optimised to control the throughput capacity and reduction of the crusher. It is a further objective to limit the throughput capacity in favour of reduction and to maximise the total net capacity for a specific application and type of crushable material.

The objectives are achieved, in part, by providing an outer crushing shell that is designed to decrease the throughput capacity via a shelf or shoulder region that restricts the flow of material through the crushing chamber in the gap between the opposed crushing shells. The creation of the shelf region is further advantageous to reduce the axial length of the shell which in turn decreases the available crushing surface area that is orientated to be radially inward facing towards the inner crushing shell. Advantageously, it has been found that restricting the capacity and crushing force area acts to increase the pressure in the crushing chamber in the gap region to increase the reduction effect.

In particular, it is identified how variations of various physical parameters of the crushing shell influence capacity and reduction to enable optimisation of the geometry of the shell. The present crushing shell may be considered to comprise three regions spatially positioned in the axial direction between a shell uppermost end and a lowermost end. In particular, the present shell has an inlet region extending axially downward from the uppermost end, a crushing region extending axially upward from the lowermost end and a shoulder region positioned axially between the inlet and crushing regions. It has been observed that the following parameters influence the capacity and reduction of the crusher:

1. an angle of inclination of a radially inward facing surface at the inlet region;
2. an angle of inclination of a radially inward facing surface at the shoulder region;
3. a wall thickness at the shoulder region between a radially inward facing surface and a radially outward facing surface; and
4. an axial length of the crushing region relative to an overall axial length of the shell between its upper and lower ends.

According to a first aspect, there is provided a gyratory crusher outer crushing shell having a main body mountable within a region of a topshell frame of a gyratory crusher, the main body extending around a central longitudinal axis the main body having a mount surface being outward facing relative to the axis for positioning against at least a part of the topshell frame and a contact surface being inward facing relative to the axis to contact material to be crushed, at least one wall defined by and extending between the mount surface and the contact surface, the wall having a first upper axial end and a second lower axial end; an orientation of the contact surface extending from the first end being inclined so as to project radially inward towards the axis in the axially downward direction to define an inlet region characterised in that an axially lowermost part of the inlet region is terminated by a shoulder region, a contact surface at the shoulder region being inclined so as to project radially inward towards the axis from the contact surface of the inlet region in an axially downward direction; wherein an angle of inclination of the contact surface of the inlet region relative to the axis is less than an angle of inclination of the contact surface of the shoulder region relative to the axis.

Optionally, the angle of inclination of the contact surface of the inlet region is in the range 1 to 40° relative to the axis. The angle of inclination of the contact surface of the inlet region can be in the range 4 to 12° relative to the axis.

Optionally, the angle of inclination of the contact surface of the shoulder region is in the range 45 to 90° relative to the axis. The angle of inclination of the contact surface of the shoulder region can be in the range 65 to 75° relative to the axis.

Optionally, an angle of inclination of the contact surface of the shoulder region is three to fifteen times greater than the angle of inclination of the contact surface of the inlet region relative to the axis. The inlet region can extend directly from the first upper axial end in the axial direction and the shoulder region extends directly from an axially lowermost part of the inlet region in the axial direction such that the contact surface comprises two surface regions of different inclination in the axial direction over the inlet region and the shoulder region from the first upper axial end.

Optionally, the contact surface from an axially lowermost part of the shoulder region to the second lower axial end defines a crushing face and comprises an axial length in the range of 40 to 85% of a total axial length of the main body from the first lower axial end to second lower axial end. The crushing face can be orientated to be declined to project radially outward relative to the axis in a downward direction from the shoulder region to the second lower axial end.

A distance by which the contact surface at the shoulder region projects radially inward from a radially innermost region of the contact surface of the inlet region is optionally 5% to 90% and can be 20% to 80%, 30% to 70%, 40% to 70%, 40% to 60%, 50% to 60% of a total radial thickness of the wall between the radially innermost shoulder part and the mount surface.

Optionally, a radially innermost part of the shoulder region is positioned in an upper 45%, 50% or 60% of an axial length of the main body closest to the first end and for example, in the range 5% to 30% of an axial length of the main body closest to the first end or 5% to 45%, 5% to 50% or 5% to 60%.

Optionally, a radially innermost part of the shoulder region is positioned at a region in the range 20 to 60% and 20 to 45% of an axial length of the main body from the first end.

The shell may have one inlet region and one shoulder region such that the shell has two inclined contact surfaces relative to axis and one declined contact surface relative to axis.

According to a second aspect, there is provided a gyratory crusher including a crushing shell as described herein.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
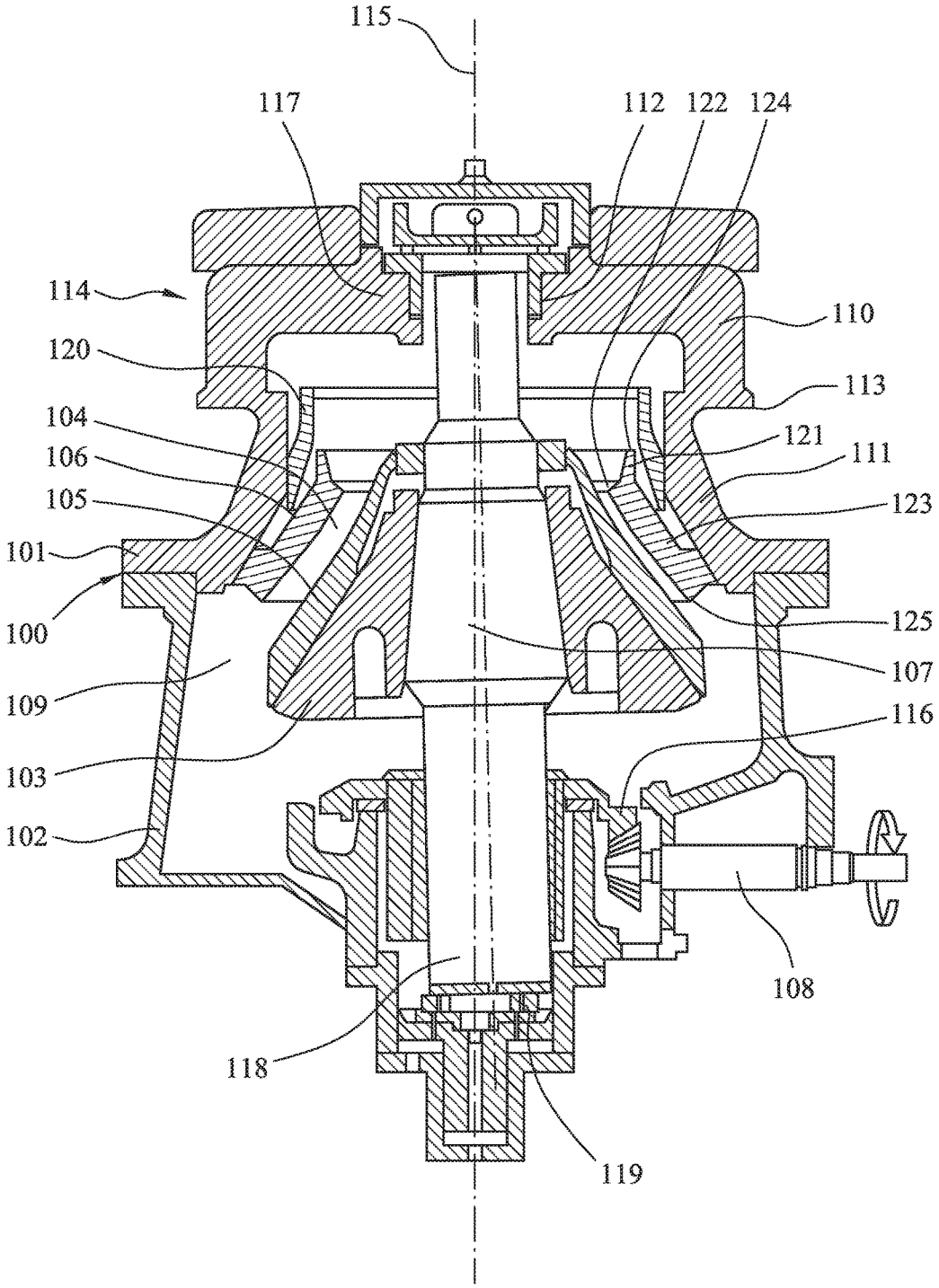
FIG. 1 is a cross sectional elevation view of a gyratory crusher having an outer crushing shell (concave) and an inner crusher shell (mantle) according to a specific implementation of the present invention.

Referring to FIG. 1, a crusher includes a frame 100 having an upper frame 101 and a lower frame 102. A crushing head 103 is mounted upon an elongate shaft 107. A first (inner) crushing shell 105 is fixably mounted on crushing head 103 and a second (outer) crushing shell 106 is fixably mounted at upper frame 101. A crushing zone 104 is formed between the opposed crushing shells 105, 106. A discharge zone 109 is positioned immediately below crushing zone 104 and is defined, in part, by lower frame 102.

A drive (not shown) is coupled to main shaft 107 via a drive shaft 108 and suitable gearing 116 so as to rotate shaft 107 eccentrically about longitudinal axis 115 and to cause head 103 and mantle 105 to perform a gyratory pendulum movement and crush material introduced into crushing chamber 104. An upper end region of shaft 107 is maintained in an axially rotatable position by a top-end bearing assembly 112 positioned intermediate between main shaft 107 and a central boss 117. Similarly, a bottom end 118 of shaft 107 is supported by a bottom-end bearing assembly 119.

Upper frame 101 is divided into a topshell 111, mounted upon lower frame 102 (alternatively termed a bottom shell), and a spider assembly 114 that extends from topshell 111 and represents an upper portion of the crusher. The spider 114 includes two diametrically opposed arms 110 that extend radially outward from central boss 117 positioned on longitudinal axis 115. Arms 110 are attached to an upper region of topshell 111 via an intermediate annular flange (or rim) 113 that is centered on axis 115. Typically, arms 110 and topshell 111 form a unitary structure and are formed integrally.

In the present embodiment, the alignment of outer crushing shell 106 at topshell 111 is achieved by an intermediate spacer ring 120 that extends circumferentially around axis 115 and is positioned axially intermediate between spider 114 and topshell 111. Accordingly, an axially uppermost first end 124 of outer shell 106 is positioned radially inward within the circumference of spacer ring 120. An axially lowermost second end 125 of shell 106 is positioned just below a lowermost part of topshell 111 and approximately at the junction between bottom shell 102 and topshell 111.

Outer shell 106 principally includes three regions in the axial direction: an uppermost inlet region 121 extending from first end 124; a crushing region 123 extending from second end 125 and a shoulder region 122 positioned axially intermediate between inlet region 121 and crushing region 123.

Figure 2:
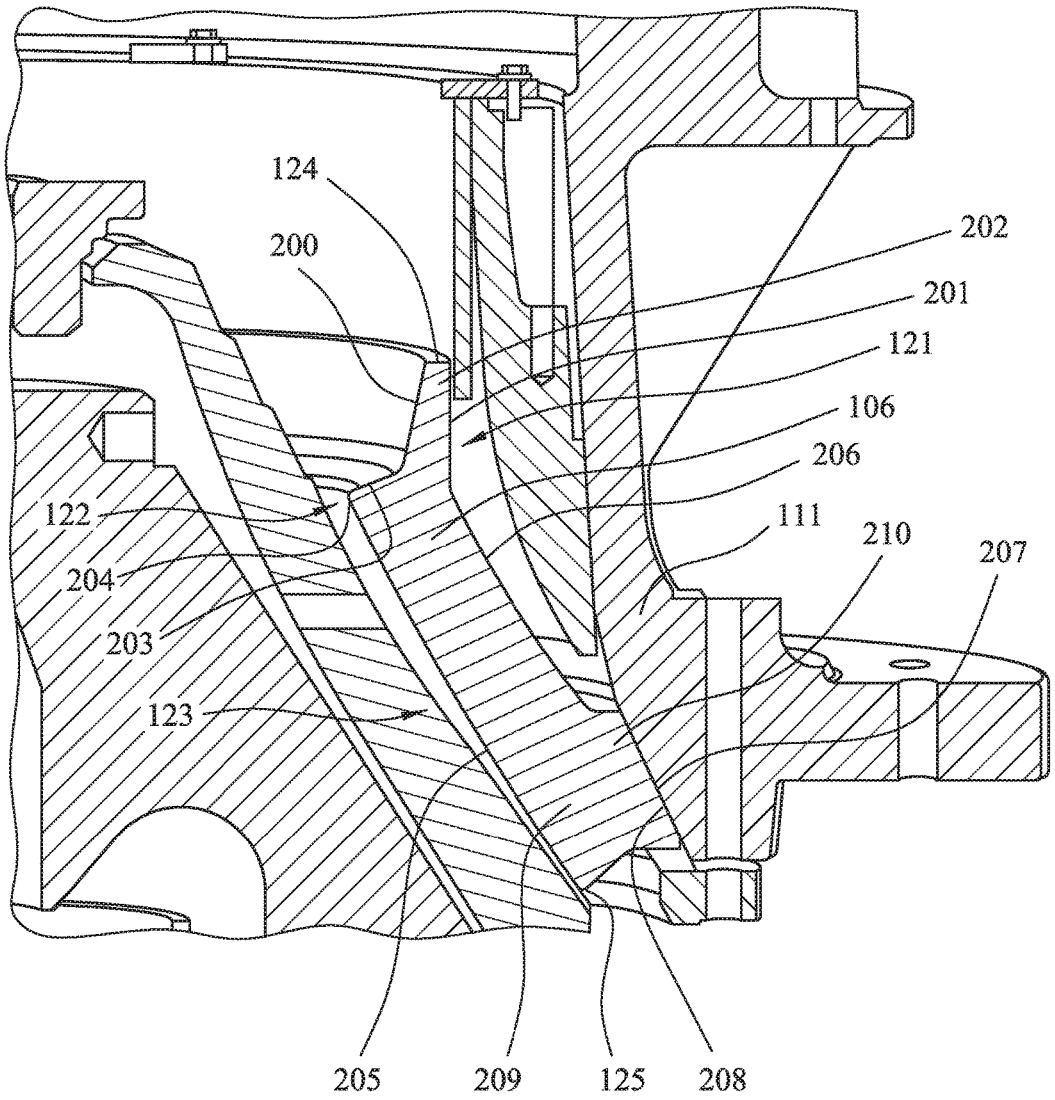
FIG. 2 is an enlarged view of the region of the crusher of FIG. 1 illustrating the outer and inner crushing shells.
Figure 4:
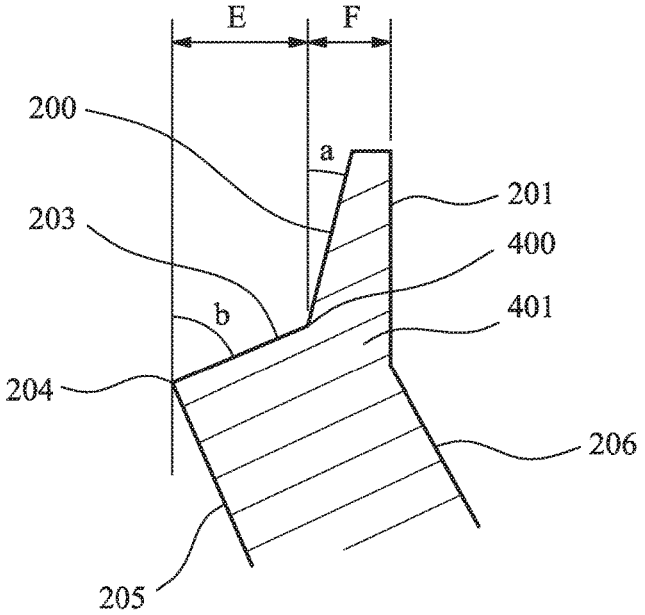
FIG. 4 is a magnified cross-sectional elevation view of the upper region of the crushing shell of FIG. 3.

Referring to FIG. 2, inlet region 121 includes a radially outward facing mount surface 201 that is aligned substantially parallel with axis 115. An opposed radially inward facing contact surface 200 is inclined radially inward from first end 124 such that a wall thickness of shell 106 at inlet region 121 increases uniformly from first end 124 to an axially lowermost base region 401 as shown in FIG. 4. The base region 401 of inlet region 121 terminates at shoulder region 122. Shoulder region 122 has a corresponding inward facing contact surface 203 that projects radially inward from inlet contact surface 200 to define a shelf 204 that represents a radially innermost region of shell 104. Crushing region 123 extends immediately below shoulder region 122 and also includes inward facing contact surface 205 and an opposed outward facing mount surface 206. Contact surface 205 is orientated to be declined and projects away from axis 115 and towards topshell 111. An axially lowermost part 209 of crushing region 123 has a radially outward facing mount surface 207 configured for close mating contact against a radially inward facing surface 208 of a lower region of topshell 111 such that shell 106 is mounted against topshell 111 via contact between opposed surfaces 207, 208.

Figure 3:
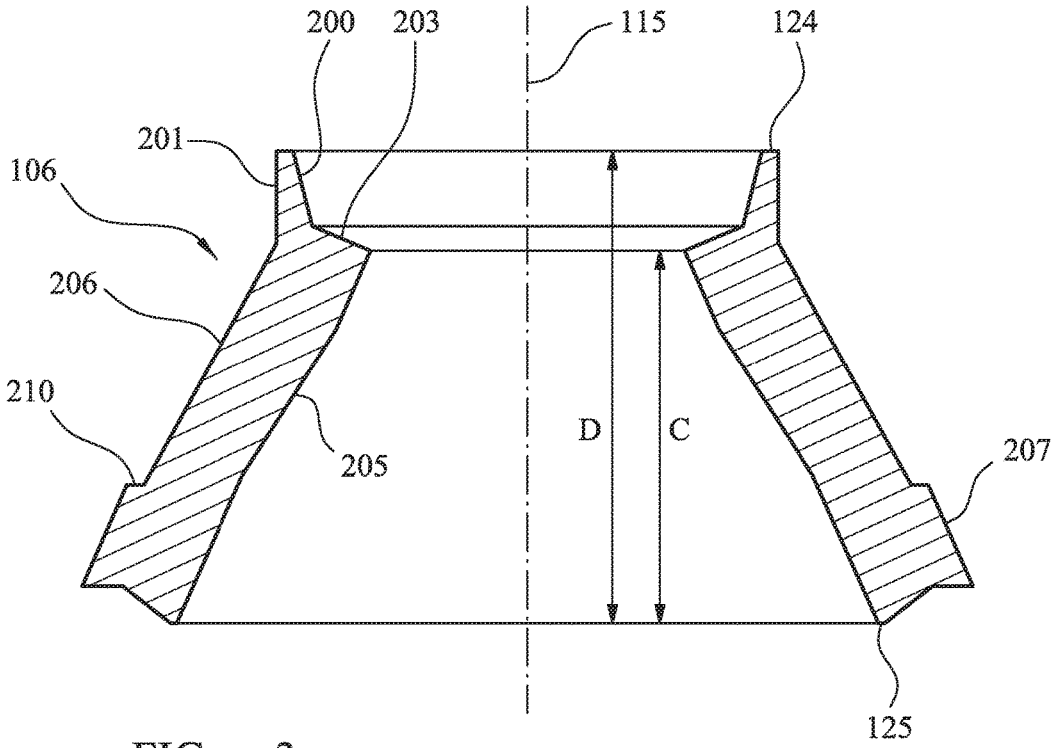
FIG. 3 is a cross-sectional elevation view of the outer crushing shell of FIG. 2.

Referring to FIGS. 3 and 4, a wall thickness of shell 106 increases from uppermost first end 124 over the axial length of inlet region 121 due to the inclined (or radially inward tapering) contact surface 200. The shell wall thickness increases further at shoulder region 122 via radially inward tapering contact surface 203. The wall thickness of shell 106 is then approximately uniform along the axial length of crushing region 123 until lowermost region 209 where the wall thickness projects radially outward to create a mounting flange 210 for contact and mounting against topshell 111.

As will be appreciated, shell 106 extends circumferentially around axis 115. As shown, in FIGS. 3 and 4, the gyratory crusher a majority of the outer crushing shell contact surface is substantially parallel with an outer surface of the inner crushing shell. With regard to the outward appearance defined by respective mount surfaces 201, 206 and 207, inlet region 121 is substantially cylindrical and the shoulder region 122 and crushing region 123 are generally frusto-conical shaped.

As illustrated, shelf 204 is positioned at an axially uppermost part of shell 106 and, in particular, in the top 25% region closest to first end 124 referring to relative axial lengths C and D (where C is the distance between shelf 204 and second lowermost end 125 and D is the distance axially between first uppermost end 124 and second end 125).

Referring to FIG. 4, an angle of inclination a of contact surface 200 is approximately 10° from central axis 115 and an angle of inclination b of contact surface 203 is approximately 70° from central axis 115. As illustrated, both contact surfaces 200, 203 are substantially linear and extend circumferentially around axis 115. The junction between surfaces 200, 203 comprises a slight curvature. Distance F represents the maximum wall thickness of shell 106 at inlet region 121. Distance F is defined as the distance between outward facing mount surface 201 and radially inward facing contact surface 200 at the inlet base region 401 representing the point of intersection of respective contact surfaces 200, 203. Radial distance E is defined as the distance between intersection point 400 and the radially innermost point 204 of the shoulder region 122. A ratio of E to F according to the specific implementation is 1:0.8. That is, the distance E is approximately 55% of the total wall thickness (E+F) between the mount surface 201 and the radially innermost point of the shoulder region 204.

The combined and respective inclination of surfaces 200 and 203 via angles a and b serve to accelerate the throughput as material falls through inlet region 121 and is directed radially inward over shelf 124. However, increasing the radial length E of shelf 204 decreases the crushing capacity. The present configuration as illustrated in FIGS. 1 to 4 is therefore optimised to control the capacity of the crusher and achieve a predetermined level specific to a particular application. Additionally, incorporating inlet region 121 and shoulder region 122 decreases the axial length of crushing region 123 along contact surface 205 from length D to length C. The crushing surface area of the contact surface 205 (that is approximately frusto-conical shaped) is therefore reduced which acts to increase the pressure in crushing region 104 where the crushing forces are applied during operation. This in turn increases the reduction effect of the crusher. It has been observed that the present relative configurations of inlet region 121; shoulder region 122 and crushing region 123 with regard to radial wall thicknesses, contact surface angles and axial lengths provides an optimised material throughput capacity and reduction and hence performance of the crusher. In particular, the following four parameters, have been found to influence the performance of the shell 106 with regard to throughput capacity and reduction: i) angle a of contact surface 200; ii) angle b of contact surface 203; iii) a radial distance E of shelf 204 and; iv) an axial length C of contact surface 205.

In particular the angle a of contact surface 200 relative to angle b of contact surface 203 defines the inlet 121 and shoulder 122 regions with these regions being significant to control capacity.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A gyratory crusher outer crushing shell comprising:

a main body arranged to be fixedly mounted to a topshell frame of a gyratory crusher, the main body extending around a central longitudinal axis;

the main body having an inlet region having a mount surface being outward facing relative to the axis for positioning against at least a part of the topshell frame and a contact surface being inward facing relative to the axis to contact material to be crushed, at least one wall of the main body being defined by and extending between the inlet region mount surface and the inlet region contact surface, the wall having a first axial end and a second axial end, an orientation of the inlet region contact surface extending from the first axial end being inclined so as to project radially inward towards the axis in an axially downward direction to define the inlet region;

an axially lowermost part of the inlet region terminated by a single shoulder region, the shoulder region having a contact surface being inclined so as to project radially inward towards the axis from the inlet region contact surface in an axially downward direction, wherein an angle of inclination of the inlet region contact surface relative to the axis is less than an angle of inclination of the shoulder region contact surface relative to the axis, wherein the single shoulder region terminates at the inlet region; and a crushing region having a crushing region contact surface extending from an axially lowermost part of the shoulder region to the second axial end, the crushing region defining a crushing face that extends immediately from the axially lowermost part of the shoulder region contact surface, the crushing face being orientated to decline and to project radially outward relative to the axis in a downward direction from the shoulder region to the second axial end, a wall thickness of the main body being approximately uniform along an axial length of the crushing region, wherein when associated with an inner crushing shell of the gyratory crusher a majority of the outer crushing shell contact surface is substantially parallel with an outer surface of the inner crushing shell.

2. The crusher shell as claimed in claim 1, wherein the angle of inclination of the contact surface of the inlet region of the outer crushing shell is in the range of 1 to 40° relative to the axis.

3. The crusher shell as claimed in claim 1, wherein the angle of inclination of the contact surface of the inlet region of the outer crushing shell is in the range of 4 to 12° relative to the axis.

4. The crusher shell as claimed in claim 1, wherein the angle of inclination of the contact surface of the shoulder region of the outer crushing shell is in the range of 45 to 90° relative to the axis.

5. The crusher shell as claimed in claim 1, wherein the angle of inclination of the contact surface of the shoulder region of the outer crushing shell is in the range of 65 to 75° relative to the axis.

6. The crusher shell as claimed in claim 1, wherein the angle of inclination of the contact surface of the shoulder region of the outer crushing shell is three to fifteen times greater than the angle of inclination of the contact surface of the inlet region relative to the axis.

7. The crusher shell as claimed in claim 1, wherein the inlet region of the outer crushing shell extends directly from the first axial end in the axial direction and the shoulder region extends directly from an axially lowermost part of the inlet region in the axial direction such that the inlet region contact surface includes two surface regions of different inclinations in the axial direction over the inlet region and the shoulder region from the first axial end.

8. The crusher shell as claimed in claim 1, wherein the crushing face includes an axial length in the range of 40 to 85% of a total axial length of the main body from the first axial end to the second axial end.

9. The crusher shell as claimed in claim 1, wherein a distance by which the contact surface at the shoulder region of the outer crushing shell projects radially inward from a radially innermost part of the shoulder region of the contact surface of the inlet region is 5% to 90% of a total radial thickness of the wall between the radially innermost part of the shoulder region and the mount surface.

10. The crusher shell as claimed in claim 1, wherein a ratio of a distance by which the contact surface at the shoulder region of the outer crushing shell projects radially inward from a radially innermost region of the contact surface of the inlet region is 40% to 70% of a total radial thickness of the wall between the radially innermost part of the shoulder region and the mount surface.

11. The crusher shell as claimed in claim 1, wherein a radially innermost part of the shoulder region is positioned in an upper 60% of an axial length of the main body closest to the first end.

12. The crusher shell as claimed in claim 1, wherein a radially innermost part of the shoulder region is positioned at a region in the range of 20 to 45% of an axial length of the main body from the first end.

13. The crusher shell as claimed in claim 1, further comprising one inlet region and one shoulder region such that the outer crushing shell includes two inclined contact surfaces relative to the axis and one declined contact surface relative to the axis.

14. A gyratory crusher comprising:

a topshell frame;

an outer crushing shell having a main body mountable within a region of the topshell frame, wherein the main body extends around a central longitudinal axis of the crusher and includes an inlet region having a mount surface being outwardly facing relative to the axis for positioning against at least a part of the topshell frame and a contact surface being inwardly facing relative to the axis to contact material to be crushed, at least one wall of the main body being defined by and extending between the inlet region mount surface and the inlet region contact surface, the at least one wall having a first axial end and a second axial end, an orientation of the inlet region contact surface extending from the first axial end being inclined so as to project radially inward towards the axis in an axially downward direction to define the inlet region, an axially lowermost part of the inlet region being terminated by a single shoulder region, the shoulder region having a contact surface being inclined so as to project radially inward towards the axis from the inlet region contact surface in an axially downward direction, wherein an angle of inclination of the inlet region contact surface relative to the axis is less than an angle of inclination of the shoulder region contact surface relative to the axis, wherein the single shoulder region terminates at the inlet region;

an inner crushing shell positioned radially inward of the outer crushing shell; and a crushing region formed between the outer and inner crushing shells and arranged to receive the material to be crushed, the outer crushing shell having a crushing region contact surface extending from an axially lowermost part of the shoulder region to the second axial end, the crushing region contact surface defining a crushing face that extends immediately from the axially lowermost part of the shoulder region contact surface, the crushing face being orientated to decline and to project radially outward relative to the axis in a downward direction from the shoulder region to the second axial end, a wall thickness of the main body being approximately uniform along an axial length of the crushing region, wherein a majority of the outer crushing shell contact surface is substantially parallel with an outer surface of the inner crushing shell.

* * * * *